US010336498B2

(12) United States Patent
Foster et al.

(10) Patent No.: US 10,336,498 B2
(45) Date of Patent: Jul. 2, 2019

(54) CONTAINER WITH IMPROVED PUNCTUREABILITY

(71) Applicant: Printpack Illinois, Inc., Elgin, IL (US)

(72) Inventors: David T. Foster, Williamsburg, VA (US); Patrick L. O'Brien, Toano, VA (US); David Cosgrove, Williamsburg, VA (US)

(73) Assignee: Printpack Illinois, Inc., Elgin, IL (US)

( * ) Notice: Subject to any disclaimer, the term of this patent is extended or adjusted under 35 U.S.C. 154(b) by 30 days.

(21) Appl. No.: 15/309,037

(22) PCT Filed: Jun. 9, 2015

(86) PCT No.: PCT/US2015/034881
§ 371 (c)(1),
(2) Date: Nov. 4, 2016

(87) PCT Pub. No.: WO2015/191565
PCT Pub. Date: Dec. 17, 2015

(65) Prior Publication Data

US 2017/0121050 A1 May 4, 2017

Related U.S. Application Data

(60) Provisional application No. 62/010,420, filed on Jun. 10, 2014.

(51) Int. Cl.
*B65D 1/40* (2006.01)
*B65D 43/02* (2006.01)
(Continued)

(52) U.S. Cl.
CPC ..... *B65D 1/40* (2013.01); *B65D 21/0209* (2013.01); *B65D 43/02* (2013.01); *B65D 85/8043* (2013.01)

(58) Field of Classification Search
CPC ..... B65D 85/8043
See application file for complete search history.

(56) References Cited

U.S. PATENT DOCUMENTS

D20,336 S 11/1890 Whilldin
D34,667 S 6/1901 Ney
(Continued)

FOREIGN PATENT DOCUMENTS

EP 0265075 A2 4/1988
EP 0278470 A2 9/1988
(Continued)

OTHER PUBLICATIONS

Mubarak et al., Effect of nucleating agents and pigments on crystallisation, morphology, and mechanical properties of polypropylene, Jul. 2000, Maney Online, vol. 29 Issue 7. http://www.maneyonline.com/doi/abs/10.1179/146580100101541111.*
(Continued)

*Primary Examiner* — Viren A Thakur
*Assistant Examiner* — Thanh H Nguyen
(74) *Attorney, Agent, or Firm* — Eversheds Sutherland (US) LLP

(57) ABSTRACT

The present description includes containers having an improved puncture design that can be punctured without substantial deformation of the container. Such containers are particularly suitable for use in preparing beverages using automatic machines, particularly those used for preparation of single serve beverages. Also provided are thermoplastic materials having improved punctureability for use in containers, containers for preparation of a beverage, and methods for preparing a beverage using such containers.

21 Claims, 5 Drawing Sheets

(51) Int. Cl.
*B65D 21/02* (2006.01)
*B65D 85/804* (2006.01)

(56) References Cited

U.S. PATENT DOCUMENTS 2,614,727 A 10/1952 Robinson
3,357,590 A 12/1967 Safford
3,420,397 A 1/1969 Miller
3,527,020 A 9/1970 Mancini
D219,526 S 12/1970 Reading
3,896,587 A 7/1975 Insalaco
3,935,955 A 2/1976 Das
D240,019 S 5/1976 Taylor
D241,228 S 8/1976 Boduch
D243,358 S 2/1977 Gross
D244,063 S 4/1977 Christian
4,154,345 A * 5/1979 Davis ..... B65D 17/161 206/527
4,193,494 A 3/1980 Green
D260,967 S 9/1981 Taylor
D270,332 S 8/1983 Gaunt
D272,418 S 1/1984 Gruodis et al.
D280,075 S 8/1985 Haag, Sr.
D280,076 S 8/1985 Haag, Sr.
4,685,273 A 8/1987 Caner et al.
D292,883 S 11/1987 Griffin
4,782,976 A * 11/1988 Kenyon, 2nd. .... B65D 21/0222 206/508
4,859,337 A 8/1989 Woltermann
4,925,048 A 5/1990 Noack
D314,704 S 2/1991 Lillelund et al.
D330,514 S 1/1992 Edwards
D327,845 S 7/1992 Behm et al.
D327,848 S 7/1992 Behm et al.
D330,330 S 10/1992 Behm et al.
5,232,120 A 8/1993 Dunken et al.
5,325,765 A 7/1994 Sylvan et al.
D351,790 S 10/1994 Haindl
5,375,719 A 12/1994 Mittmann et al.
5,419,436 A 5/1995 Powell
D361,956 S 9/1995 Moore
D364,564 S 11/1995 Moore
D380,383 S 7/1997 Wiemann et al.
D390,460 S 2/1998 Schmidt
D391,482 S 3/1998 Wiemann et al.
D398,528 S 9/1998 Wiemann et al.
D399,452 S 10/1998 Durbin
5,840,189 A 11/1998 Sylvan et al.
D405,386 S 2/1999 Ross
5,992,632 A 11/1999 Karren
6,024,244 A 2/2000 Hicks
6,086,931 A 7/2000 Whiteford
6,134,832 A 10/2000 Bokmiller et al.
6,138,862 A 10/2000 Tai
D435,216 S 12/2000 Paoloski
D438,794 S 3/2001 Miles et al.
D452,434 S 12/2001 Sweeney
6,440,256 B1 8/2002 Gordon et al.
D474,110 S 5/2003 Sweeney
D474,111 S 5/2003 Lazaris
6,589,577 B2 7/2003 Lazaris
6,607,762 B2 8/2003 Lazaris et al.
6,645,537 B2 11/2003 Sweeney et al.
D484,809 S 1/2004 Pascuzzo
6,683,125 B1 1/2004 Augestad et al.
6,740,345 B2 5/2004 Cai
6,810,788 B2 11/2004 Hale
6,837,377 B2 1/2005 Shuert
D502,362 S 3/2005 Lazaris et al.
D502,870 S 3/2005 Bennett et al.
D504,814 S 5/2005 Bretz et al.
D505,882 S 6/2005 Hensen
6,948,420 B2 9/2005 Kirschner et al.
D519,831 S 5/2006 de Cleir et al.
D522,368 S 6/2006 Darr et al.
D528,422 S 9/2006 Darr et al.
D530,615 S 10/2006 Darr et al.
D532,293 S 11/2006 Martin
D532,307 S 11/2006 Durand
D541,147 S 4/2007 LaMasney
7,204,056 B2 4/2007 Sieverding
7,213,506 B2 5/2007 Halliday et al.
D554,507 S 11/2007 Laupie
D554,508 S 11/2007 YunFu
D562,726 S 2/2008 Courson et al.
D574,242 S 8/2008 Lin
D577,288 S 9/2008 Wilson et al.
D595,581 S 7/2009 Brunson
D603,221 S 11/2009 Liu et al.
D605,502 S 12/2009 Honda et al.
D606,363 S 12/2009 Aardenburg
7,624,535 B2 12/2009 Schmidt
7,624,673 B2 12/2009 Zanetti
D607,329 S 1/2010 Diss
7,677,435 B2 3/2010 Stahlecker
D616,704 S 6/2010 Hou
D620,310 S 7/2010 Lundberg
D622,147 S 8/2010 Pedmo
D623,063 S 9/2010 Pedmo
7,789,255 B2 9/2010 Loppas
D626,829 S 11/2010 Touchet
D628,442 S 12/2010 Lundberg
D628,476 S 12/2010 Vang
D628,883 S 12/2010 Stephens
D630,947 S 1/2011 Mashouf
7,891,513 B2 2/2011 Mody et al.
D637,484 S 5/2011 Winkler
7,981,451 B2 7/2011 Ozanne
D643,734 S 8/2011 Perez
D645,340 S 9/2011 Menard et al.
D647,398 S 10/2011 Winkler
D647,399 S 10/2011 Winkler
D648,212 S 11/2011 Golota et al.
D649,405 S 11/2011 Lingo
D651,096 S 12/2011 Nakagiri
D651,901 S 1/2012 Miller et al.
D652,266 S 1/2012 Smyers
D656,009 S 3/2012 Ortiz et al.
8,127,663 B2 3/2012 Nottingham et al.
8,230,775 B2 7/2012 Vanni
D683,545 S 6/2013 Refior
D684,065 S 6/2013 Wiseman
D686,916 S 7/2013 O'Brien et al.
D687,297 S 8/2013 O'Brien et al.
D689,768 S 9/2013 Inderbitzin
D695,110 S 12/2013 Houlton et al.
D695,615 S 12/2013 Rapparini
D698,649 S 2/2014 Quint
D700,839 S 3/2014 O'Brien et al.
D712,203 S 9/2014 Lordi
D715,649 S 10/2014 O'Brien
D730,174 S 5/2015 O'Brien
D731,884 S 6/2015 Trombetta
D731,890 S 6/2015 Trombetta
D732,390 S 6/2015 Tarombetta
2002/0112983 A1 8/2002 Padovani
2002/0134701 A1 9/2002 Olsthoom et al.
2002/0148356 A1 10/2002 Lazaris et al.
2003/0222089 A1* 12/2003 Hale ..... B65D 85/8043 220/574
2004/0173565 A1 9/2004 Semersky et al.
2005/0017013 A1 1/2005 Peisach et al.
2005/0051478 A1 3/2005 Karanikos
2005/0173287 A1 8/2005 Smith et al.
2005/0255678 A1 11/2005 Kato
2006/0196364 A1 9/2006 Kirschner
2007/0051836 A1 3/2007 Kirschner et al.
2007/0161739 A1 7/2007 Helland et al.
2009/0162683 A1* 6/2009 Douard ..... C08K 5/42 428/480
2009/0175986 A1* 7/2009 Doglioni Majer ..... B65D 85/8043 426/77
2009/0194546 A1 8/2009 Lane

(56) References Cited

U.S. PATENT DOCUMENTS

| | | | | |
|---|---|---|---|---|
| 2009/0200301 | A1 | 8/2009 | Beckman et al. | |
| 2010/0018889 | A1 | 1/2010 | Korpanty et al. | |
| 2010/0064899 | A1 | 3/2010 | Aardenburg | |
| 2010/0072165 | A1 | 3/2010 | Schau | |
| 2010/0239717 | A1 | 9/2010 | Yoakim et al. | |
| 2010/0288131 | A1* | 11/2010 | Kilber | B65D 85/8043 99/295 |
| 2010/0288133 | A1 | 11/2010 | Litzka et al. | |
| 2010/0303964 | A1* | 12/2010 | Beaulieu | B65D 85/8043 426/77 |
| 2010/0303965 | A1 | 12/2010 | Mariller | |
| 2010/0317779 | A1 | 12/2010 | Pham et al. | |
| 2011/0005399 | A1 | 1/2011 | Epars | |
| 2011/0041702 | A1 | 2/2011 | Yoakim | |
| 2011/0076361 | A1 | 3/2011 | Peterson et al. | |
| 2011/0142996 | A1 | 6/2011 | Krüger | |
| 2011/0147392 | A1 | 6/2011 | Trude et al. | |
| 2011/0151075 | A1 | 6/2011 | Peterson | |
| 2011/0183048 | A1 | 7/2011 | Noble | |
| 2011/0240506 | A1 | 10/2011 | D'Amato | |
| 2011/0259205 | A1 | 10/2011 | Delome | |
| 2011/0283890 | A1 | 11/2011 | Scrivani | |
| 2011/0305801 | A1 | 12/2011 | Beer | |
| 2012/0006205 | A1 | 1/2012 | Vanni | |
| 2012/0012647 | A1 | 1/2012 | Almabekov | |
| 2012/0055832 | A1 | 3/2012 | Riethmueller | |
| 2012/0058226 | A1 | 3/2012 | Winkler | |
| 2012/0097602 | A1 | 4/2012 | Tedford | |
| 2012/0121764 | A1 | 5/2012 | Lai et al. | |
| 2012/0121768 | A1 | 5/2012 | Lai et al. | |
| 2012/0171332 | A1 | 7/2012 | Lai et al. | |
| 2012/0201933 | A1 | 8/2012 | Dran et al. | |
| 2014/0120217 | A1 | 5/2014 | O'Brien et al. | |
| 2014/0120218 | A1 | 5/2014 | O'Brien et al. | |
| 2014/0308406 | A1 | 10/2014 | O'Brien et al. | |
| 2014/0377413 | A1 | 12/2014 | Liu | |

FOREIGN PATENT DOCUMENTS

| | | | | | |
|---|---|---|---|---|---|
| EP | 0615921 | A1 | | 11/1994 | |
| EP | 3953602 | A1 | | 3/1999 | |
| EP | 1344724 | A1 | | 9/2003 | |
| EP | 1886942 | A1 | | 2/2008 | |
| EP | 2572609 | A1 | | 1/2012 | |
| EP | 2444339 | A1 | | 4/2012 | |
| EP | 2570369 | A1 | | 3/2013 | |
| JP | 09176328 | A | * | 7/1997 | |
| JP | 10273569 | | | 10/1998 | |
| WO | 2005080223 | A1 | | 9/2005 | |
| WO | 2008136026 | | | 11/2008 | |
| WO | 2012011053 | | | 1/2012 | |
| WO | 2012055751 | | | 5/2012 | |
| WO | 2012122329 | | | 9/2012 | |
| WO | WO2014027297 | A1 | * | 2/2014 | B65D 85/8043 |
| WO | 2014066901 | A1 | | 5/2014 | |
| WO | 2014168940 | A1 | | 10/2014 | |

OTHER PUBLICATIONS

Mubarak et al., Effect of nucleating agents and pigments on crystallization, morphology, and mechanical properties of polypropylene, Jul. 2000, Maney Online, vol. 29 Issue 7. http://www.maneyonline.com/doi/abs/10.1179/146580100101541111.

A photo of a Swiss Miss cup shaped container, updated, admitted prior art.

International Preliminary Report on Patentability for International Application No. PCT/US2015/034881, dated May 27, 2016 (16 pages).

International Search Report and Written Opinion for International Application No. PCT/US2015/034481, dated Aug. 14, 2015 (12 pages).

* cited by examiner

CONTAINER WITH IMPROVED PUNCTUREABILITY

CROSS-REFERENCE TO RELATED APPLICATIONS

This application is a U.S. national stage application of International Application No. PCT/US2015/034881, filed Jun. 9, 2015, which claims priority of U.S. Provisional Application No. 62/010,420, filed on Jun. 10, 2014, the disclosure of which are incorporated by reference herein.

BACKGROUND

The present application relates generally to the field of containers for preparation of beverages, especially coffee and tea. These containers commonly are referred to as cartridges, cups, capsules, or pods, and are particularly suitable for use in the preparation of a single-serve beverage.

In recent years, single-serve beverage machines have become popular in homes and businesses as a quick and convenient manner of brewing beverages. These machines generally brew coffee, tea, or other hot beverages through polymer containers that may have integral filters and are filled with coffee grinds, tea leaves, or other soluble products. Upon brewing of these products, the container may be easily discarded so that the machine is available for preparation of subsequent beverages. These containers thereby enable users to customize their beverages and also enjoy freshly brewed beverages quickly and easily.

Although convenient, existing containers used for the preparation of beverages have numerous drawbacks. For example, many commercially available containers are prepared using materials that are less easily recycled. This is due at least in part due to the structural characteristics that are required for these containers. For example, the containers must be sufficiently strong to permit puncturing of the base of the container without substantial deformation of the container.

Containers and materials having improved punctureability recently have been developed and are described in U.S. patent application Ser. Nos. 14/034,307 and 14/034,298, the disclosures of which are incorporated herein by reference. Although these containers have proven to significantly improve punctureability as compared to prior art designs, the modified designs in these applications have experienced some issues during processing using certain types of equipment (e.g., equipment which is designed to pick up and place the container from its base). Thus, there is a need for further design modifications that do not suffer from the difficulties experienced during processing of the containers with existing equipment while also providing the needed improved punctureability.

SUMMARY

Embodiments of the present description address the above-described needs by providing a container including a substantially circular base; a frustoconically shaped wall extending therefrom and defining a cavity therein; and a stacking shoulder which intersects and extends laterally from the wall. The base includes an outer support structure with an inwardly sloping continuous puncture region therein, the continuous puncture region displaying a puncture load of less than 3 kg, measured using a sharp needle, or of less than 5 kg, measured using a dull needle. The outer support structure desirably is positioned an effective distance from the edge of the base to increase the punctureability of the base in the continuous puncture region.

Also provided in embodiments herein are containers for preparation of a beverage using the above-described container and methods for preparing a beverage using such containers.

DETAILED DESCRIPTION

Figure 1:
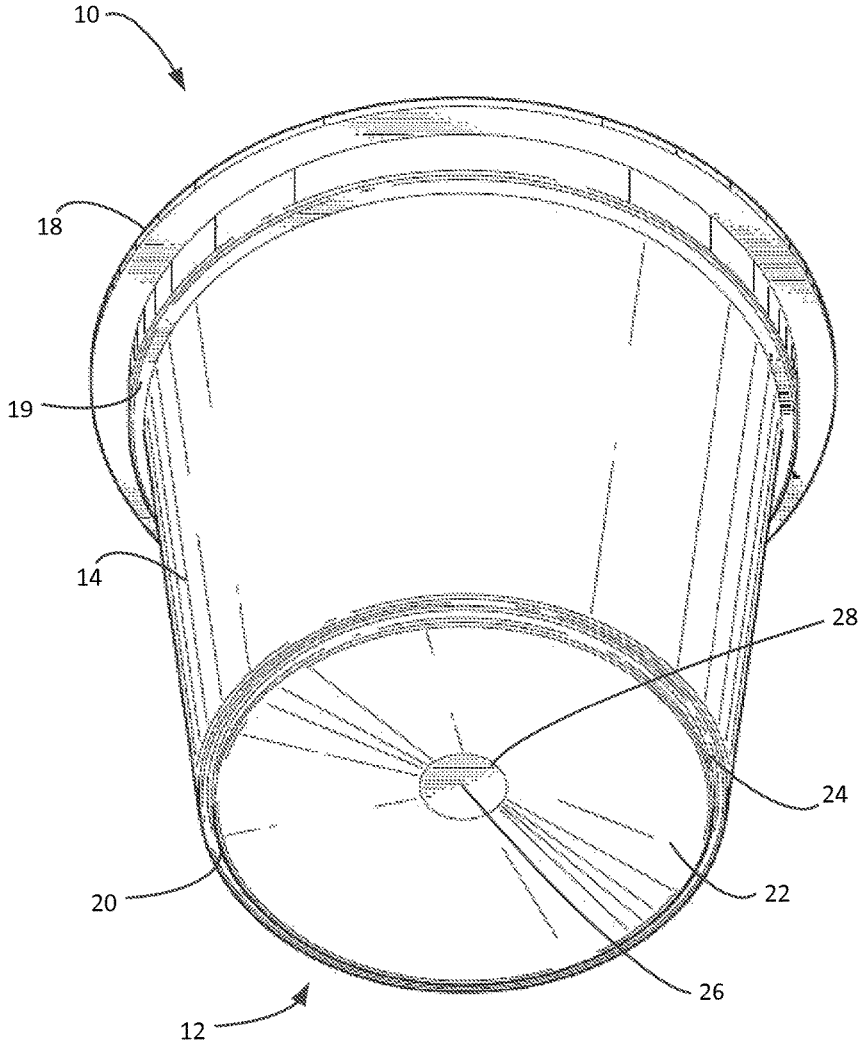
FIG. 1 is a forward lower perspective view of a container according to a first embodiment.
Figure 2:
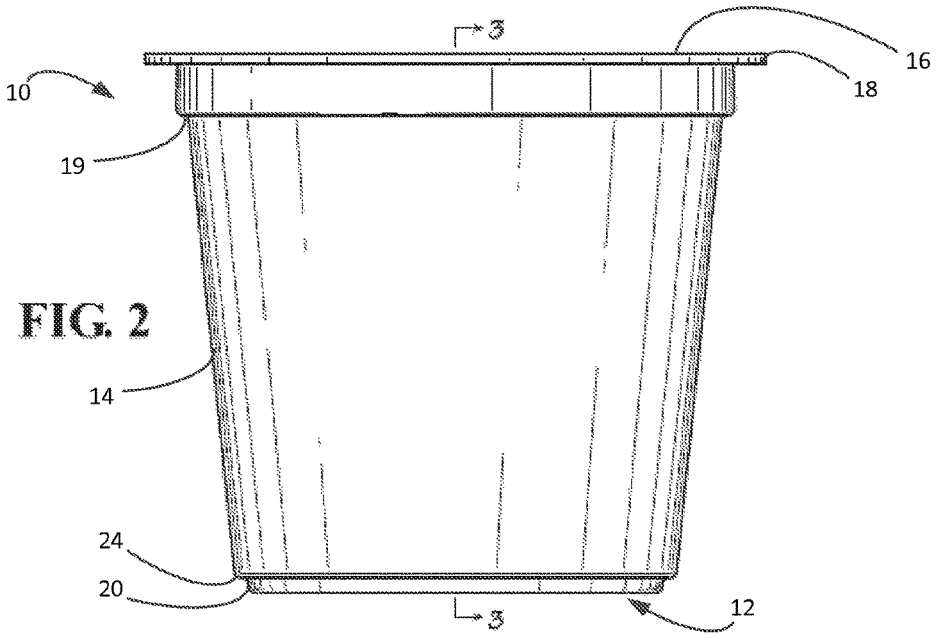
FIG. 2 is a side view of the container illustrated in FIG. 1.
Figure 3:
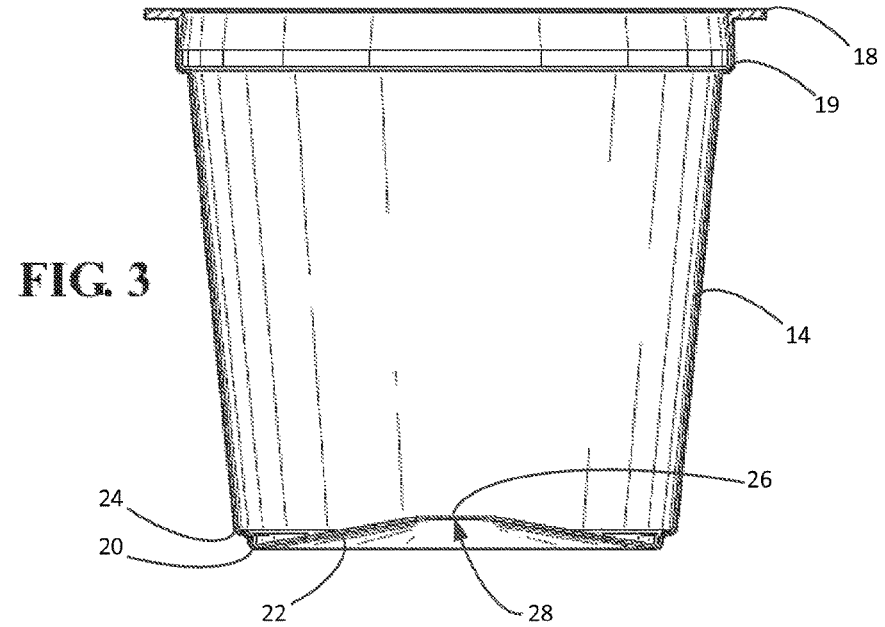
FIG. 3 is a cross-sectional view of the container illustrated in FIG. 1.

Embodiments of the present application address the above-described needs by providing a container for preparation of a beverage. As used herein, the term "container" is synonymous with cartridges, cups, capsules, pods, and the like, that may be used in the preparation of a beverage.

The container generally comprises a cup-shaped container with a base and a frustoconically shaped sidewall defining an opening. In an embodiment, the base includes an outer support structure. A continuous puncture region disposed within the outer support structure is configured to permit the container base to be punctured in the continuous puncture region during the preparation of the beverage. The outer support structure desirably is positioned an effective distance from the edge of the base to increase the punctureability of the base in the continuous puncture region.

An exemplary embodiment of a container 10 is further illustrated in FIGS. 1-4. The container 10 comprises the base 12 and the frustoconically shaped sidewall 14 defining an opening 16. The sidewall 14 may include a radially outwardly protruding lip 18 surrounding the opening 16. In one aspect, the radially outwardly protruding lip 18 further comprises a stacking shoulder 19 that intersects and extends laterally from the sidewall 14. The base 12 includes an outer support structure 20 surrounding a continuous puncture region 22, the outer support structure 20 being positioned an effective distance away from the edge 24 of the base 12. The continuous puncture region disposed inside the outer support structure 20 is configured to permit the puncture of the container base at any position in the continuous puncture region 22 during preparation of the beverage without regard for the position of the puncture region.

Not wishing to be bound by any theory, the position of the outer support structure an effective distance from the edge of the base changes the mode of failure of the container and increases the rigidity of the base, thereby improving the punctureability of the base in the continuous puncture region. In exemplary embodiments, an effective distance from the edge of the base is from about 1 to about 10 mm, from about 1 to about 5 mm, from about 1.5 to about 2.5 mm, or from about 2.0 to about 2.5 mm. For example, in an embodiment the outer support structure may be positioned about 2.3 mm from the edge of the base.

The continuous puncture region 22 may be inwardly sloping from horizontal towards the center 26 of the container base 12 (i.e., forming a cone-like shape). In embodiments, the continuous puncture region 22 may extend to the center 26 of the container base 12 (i.e., forming an apex of the cone) or may plateau into a flat region 28 at the center 26 of the container base 12. As used herein, the term "horizontal" refers to the plane that is perpendicular the longitudinal axis of the container (i.e., the center line extending through the center 26 of the container base to the center of the opening 16 of the container).

Figure 5:
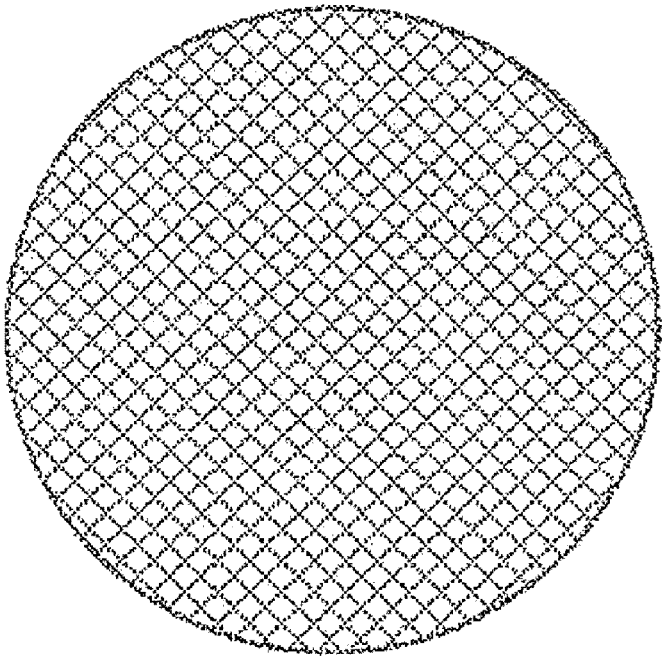
FIG. 5 is a schematic of a design that may be applied to the inner surface of a cup base according to an embodiment.
Figure 6:
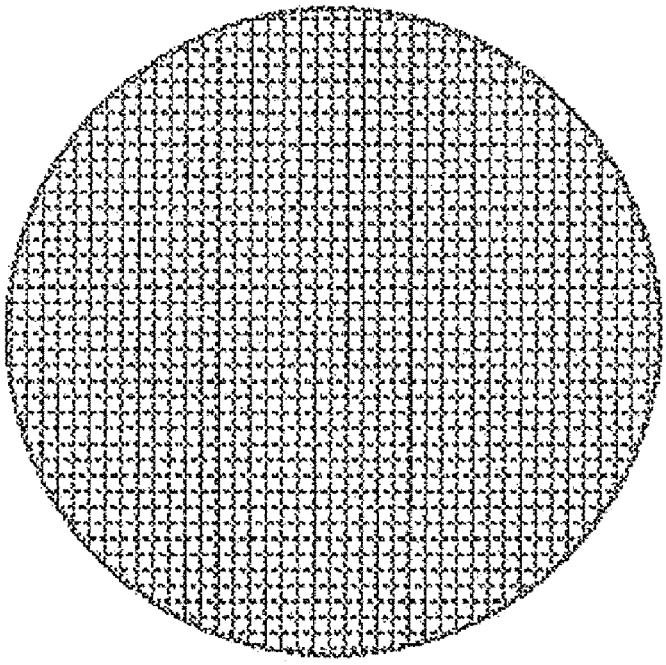
FIG. 6 is a schematic of a design that may be applied to the inner surface of a cup base according to an embodiment.

In embodiments, the container further comprises other features to facilitate the punctureability of the base in the continuous puncture region. For example, in an embodiment the container may include a feature in the inner surface of the base of the container. The feature may be effective to weaken the material of the base in the continuous puncture region during its puncture without sacrificing its strength, for example, by providing stress concentrators. Two exemplary embodiments of the feature are illustrated in FIGS. 5 and 6, which illustrate the designs that may be imprinted in the inner surface of the base of the container. Other designs also may be used.

Figure 4:
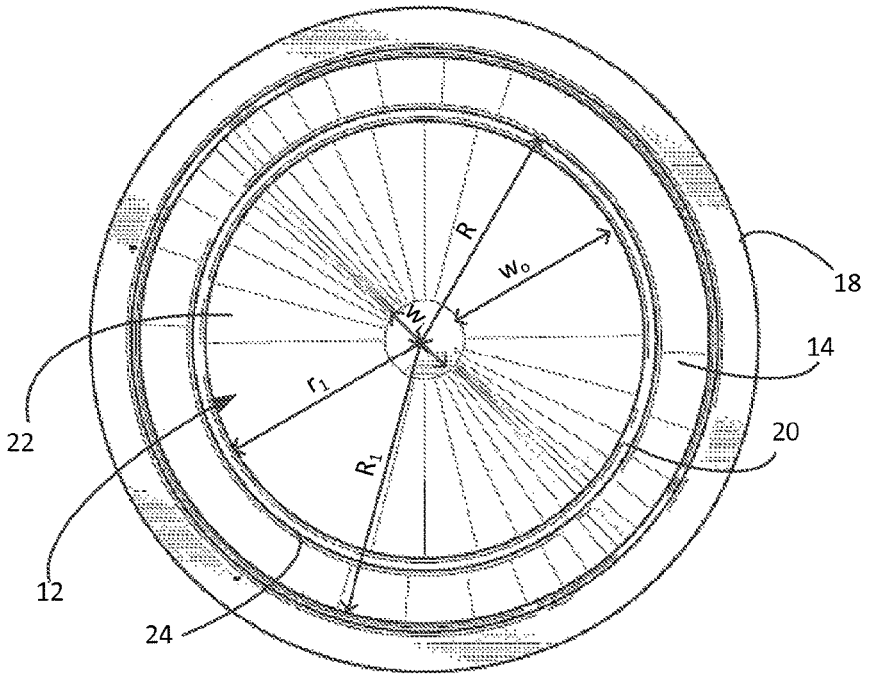
FIG. 4 is a top view of the container illustrated in FIG. 1.
Figure 7:
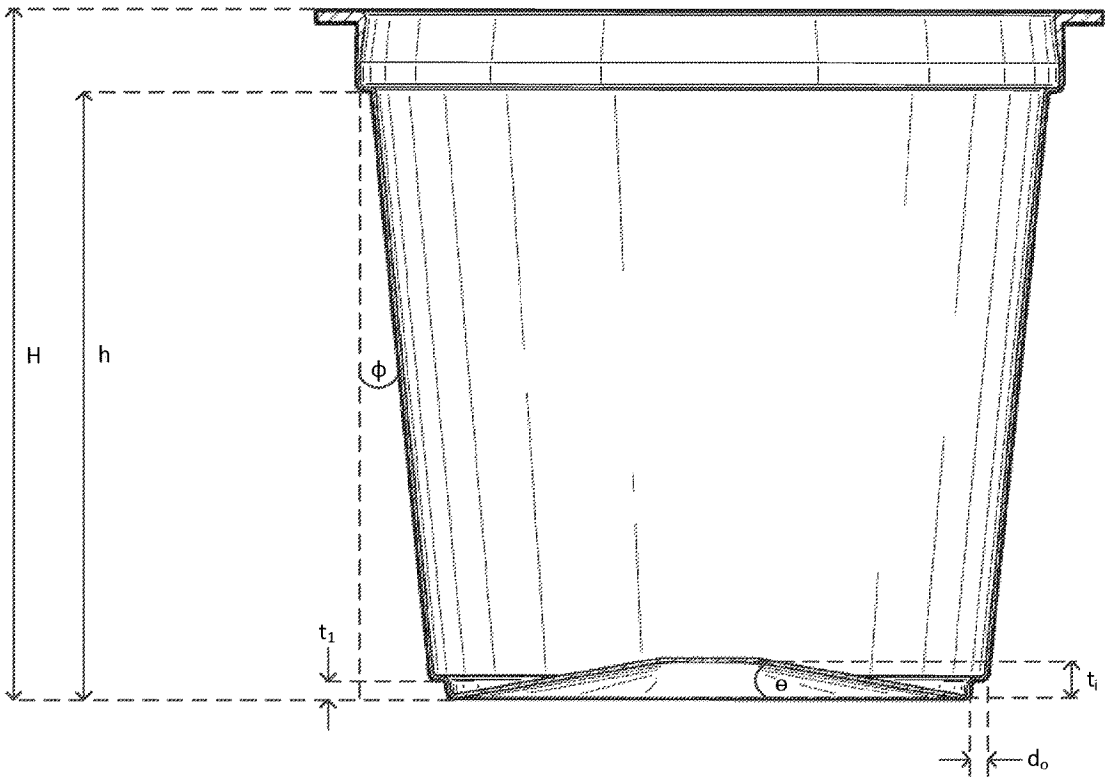
FIG. 7 is a cross-sectional side view of an embodiment of the container illustrated in FIG. 1.

In an embodiment, shown in FIGS. 4 and 7, the container may be further characterized by the following mathematical relationship:

$$h=(R_1-R)\cdot\tan(90-\Phi)$$

wherein h is the height of the container from the base 12 to the stacking shoulder 19, $R_1$ is the inner radius of the container at the stacking shoulder 19, R is the radius of the base 12 at the edge 24 of the base, and Φ is the approach angle.

The container also can further be characterized by the dimensions of the base features (FIGS. 4 and 7): $r_1$ is the radius of the base 12 to the outer support structure 20, $d_o$ is the effective distance from the edge 24 of the base to the outer support structure 20, $w_i$ is the width of the flat region 28, $w_o$ is the width of the continuous puncture region 22 of the base 12, $t_1$ is the height of the outer support structure 20, relative the edge 24 of the base, $t_i$ is the height of the center 26 of the base 12, relative the bottom most portion of the outer support structure 20, and θ is the taper angle of the base 12. Accordingly, in certain embodiments the base 12 is further characterized by the following mathematical relationships:

$$d_o=R-r_1>0.01$$

$$R>r_1$$

$$w_o=r_1-\tfrac{1}{2}w_i$$

Exemplary ranges of the foregoing variables are summarized in the table below.

| Dimension | | Exemplary Ranges |
|---|---|---|
| height of the container | H | 20.0 mm-100.0 mm |
| inner radius of the container at the stacking shoulder | $R_1$ | 11.0 mm-55.0 mm |
| radius of the base | R | 10.0 mm-50.0 mm |
| approach angle of the sidewall | Φ | 2 degrees-10 degrees |
| effective distance from edge of base to outer support structure | $d_o$ | 0.5 mm-10.0 mm |
| radius of outer support structure | $r_1$ | 4.5 mm-49.5 mm |
| height of outer support structure | $t_1$ | 0.5 mm-5.0 mm |
| width of flat region | $w_i$ | 0.0 mm-16.0 mm |
| height of center of base | $t_i$ | 0.05 mm-3.0 mm |
| taper angle of base | θ | 0.5 degrees-10 degrees |

In an exemplary embodiment, the outer support structure may be disposed about 0.75 to about 1.5 mm from the edge of the base ($d_o$), the taper angle (θ) may be from about 1 to about 5 degrees relative to horizontal, the flat region may have a width ($w_i$) from about 5.0 to about 10.0 mm, and the height ($t_i$) at the center of the base may be from about 0.25 to about 1.0 mm. For example, in an embodiment the outer support structure may be disposed about 1.1 mm from the edge of the base ($d_o$), the taper angle (θ) may be about 3.2 degrees relative to horizontal, the flat region may have a width ($w_i$) of about 6.0 mm, and the height ($t_i$) at the center of the base may be about 0.75 mm.

In embodiments, a self-supporting filter element (not illustrated) known to those skilled in the art may be disposed in the container and either removably or permanently joined to an interior surface of the container. For example, the filter may be in the shape of an inverted hollow cone having a curved wall tapering evenly from a rim surrounding an opening. The filter element then may be placed in the container so that the apex of the cone is supported on and slightly flattened by the base of the container, thereby enlarging the volume within the cone and providing beneficial support for the filter element.

In embodiments, the container provided herein further comprises a pierceable cover in a hermetically sealed relationship with the lip of the container, closing the opening to form a cartridge. The cover desirably is formed of an impermeable and imperforate material that may be pierced with an instrument, such as a tubular needle, through which hot water is delivered for preparation of the beverage. For example, in embodiments the cover may comprise a polymer film or a foil heat-sealed to the lip of the container.

In embodiments, the containers may be prepared by molding and thermoforming the container from a thermoplastic material. Desirably, the thermoplastic material is substantially impermeable and imperforate. Non-limiting examples of suitable thermoplastic materials include polyolefins such as polypropylene and polyethylene, polystyrene, nylon, and other polymers. In particular embodiments, it is particularly desirable that the thermoplastic material be a bio-based resin, readily recyclable, and/or comprise at least a portion of recycled material. For example, in an embodiment the thermoplastic material may comprise a recycled polypropylene base resin.

In embodiments, the thermoplastic material may be blended with one or more additives to impart the desired mechanical and thermal properties to the container. For example, in embodiments the thermoplastic material may be blended with one or more additives to impart the desired stiffness to the container. In an embodiment, the additive comprises an immiscible polymer that may function as a stress concentrator by hindering the natural ability of the thermoplastic material to deform plastically and promoting controlled crack propagation. Non-limiting examples of immiscible polymers that may be suitable for use with a thermoplastic material comprising polypropylene include acrylics, styrenics, or their blends and copolymers with polyolefins. In an embodiment, the additive comprises a nucleating agent. In an embodiment, a second additive comprises a metallic stearate, non-limiting examples of which include calcium stearate, magnesium stearate, zinc stearate, and combinations thereof. Other non-limiting examples of additives include calcium carbonate, talc, clays, and nano grades of these additives.

In embodiments, the thermoplastic material comprises a blend of a thermoplastic polymer, a nucleating agent, and a second additive selected from the group consisting of calcium carbonate, talc, clay, and combinations thereof. For example, the nucleating agent may be present in the thermoplastic material in an amount from about 0.5 to about 5% by weight or about 0.5 to about 2.5% by weight, and the second additive may be present in an amount from about 5 to about 25% by weight, about 5 to about 20% by weight, about 7 to about 18% by weight, about 7 to about 12% by weight, or about 9% by weight. For example, in embodiments the thermoplastic material may comprise a polypropylene, a nucleating agent in an amount from about 0.5 to about 2.5% by weight, and a second additive (e.g., talc) in an amount from about 7 to about 12% by weight. Thus, the thermoplastic material may include the thermoplastic polymer in an amount of at least 70% by weight, from about 70 to about 95% by weight, or from about 70 to about 90% by weight.

In embodiments, the thermoplastic material comprises a monolayer or a multilayer material having at least two layers. Such materials are known to those skilled in the art. For example, the thermoplastic material may include a multilayered film having one or more layers formed of a thermoplastic polymer and a barrier layer configured to improve the barrier properties of the material. The multilayered film also may include one or more tie layers disposed between the barrier layer and adjacent thermoplastic polymer layers and, optionally, one or more layers of regrind. Non-limiting examples of barrier layers commonly used in the art include ethylene vinyl alcohol (EVOH) and nylon, with the amount of the additive in the barrier layer being determined at least in part by the particular application for which the container will be used.

For example, in an exemplary embodiment the thermoplastic material is a multilayered film having five (5) layers: thermoplastic polymer/tie layer/barrier layer/tie layer/thermoplastic polymer layer. For example, the thermoplastic polymer may be a polypropylene and the barrier layer may include ethylene vinyl alcohol (EVOH). In another exemplary embodiment, the thermoplastic material is a multilayered film having seven (7) layers: thermoplastic polymer/regrind/tie layer/barrier layer/tie layer/regrind/thermoplastic polymer. Thus, the outermost layer opposite the cavity of the container, the innermost layer adjacent the cavity of the container, or both, may comprise the disclosed thermoplastic polymer layers. In certain embodiments, a multilayer material forming the container includes a barrier layer between the innermost and outermost layers.

Desirably, the containers provided herein have a puncture load of less than about 6 kg. As used herein, the "puncture load" means the force required to puncture the continuous puncture region in the base of the container using a needle. It should be appreciated that the puncture load depends in part on the type of needle used to measure the puncture load of a container. For example, the puncture load measured using a dull needle generally will be greater than the puncture load measured using a sharp needle. For example, in embodiments the containers may have a puncture load measured using a sharp needle of less than about 3 kg, less than about 2.75 kg, or less than about 2.5 kg. In embodiments, the containers may have a puncture load measured using a sharp needle of about 4.2 to about 3 kg, about 2.99 to about 2.75 kg, or about 2.74 to about 2.5 kg. In embodiments, the containers may have a puncture load measured using a dull needle of less than about 5 kg. For example, the containers may have a puncture load measured using a dull needle of about 4.0 to about 5.0 kg. In one embodiment, the continuous puncture region displays a puncture load of less than 3 kg, measured using a sharp needle, or of less than 5 kg, measured using a dull needle.

Therefore, the containers described herein advantageously provide improved punctureability due to the base structure, including the outer support structure. The outer support structure may be designed to achieve the desired puncture loads in containers of various materials. In certain embodiments, the container is a polypropylene-based container, meaning the container comprises a monolayer material including polypropylene in an amount of at least 70 percent by weight, or a multilayer material in which at least one layer includes polypropylene in an amount of at least 70 percent by weight. Polypropylene-based containers beneficially may be readily recyclable at commercial recycling facilities. Thus, containers of the present disclosure may be easily recycled and provide the punctureability of similar non-recyclable containers.

In embodiments, the container may be configured to receive an insert in which the dry beverage ingredients are disposed. For example, the container may be configured to receive an insert comprising a filter cup in which are disposed the ingredients for preparing a beverage. For example, the container may further comprise a filter cup comprising a brew substance, non-limiting examples of which include coffee grinds, ground tea leaves, chocolate, flavored powders, and the like. The brew substance also may include a combination of dry milk, sugar or sugar substitute, or other flavorings to enhance the quality of the resulting beverage.

The containers embodied herein are particularly suited for use in an automatic machine, such as a coffee brewing machine. Upon placing the container in the machine, a piercing member punctures the cover to introduce pressurized hot water through the hole where it comes into contact with the beverage ingredients disposed in the filter. A second piercing member punctures the base of the container at any position in the continuous puncture region to enable the prepared beverage to flow out of the container and be dispensed into a cup or container for consumption by the consumer.

The containers provided herein also may be configured for use with other types of food products, non-limiting examples of which include dry ingredients for preparing broths, soups, and sauces that may be eaten be themselves or used to prepare a food dish.

It should be apparent that the foregoing relates only to certain embodiments of the present application and the resultant patent. Numerous changes and modifications may be made herein by one of ordinary skill in the art without departing from the general spirit and scope of the invention as defined by the following claims and the equivalents thereof.

We claim:

1. A container comprising:

a substantially circular base;

a frustoconically shaped wall extending from an edge of the base and defining a cavity therein; and a stacking shoulder which intersects and extends laterally from the wall, opposite the base;

wherein the base comprises an outer support structure surrounding an inwardly sloping continuous puncture region, the outer support structure being positioned from 0.5mm to 10.0 mm from the edge of the base and having a height of from 0.5 mm to 5.0 mm, relative the edge of the base, to increase the punctureability of the base, wherein the inwardly sloping continuous puncture region extends from the outer support structure to a flat area extending radially from a center of the base, the flat area having a width from 5.0 to 10.0 mm, wherein the outer support structure comprises a sidewall and the base comprises an annular wall extending between the sidewall of the outer support structure and the edge of the base, the annular wall extending completely along a plane parallel to a plane in which the flat area extends completely, and wherein the inwardly sloping continuous puncture region has a constant slope at an angle (θ) relative to a lateral axis at a bottom of the outer support structure which is greater than zero.

2. The container of claim 1, wherein the angle (θ) is up to 10degrees, relative to horizontal.

3. The container of claim 1, wherein the inwardly sloping continuous puncture region has a height at a center of the base from greater than 0 up to 3.0 mm, relative to a bottom of the outer support structure.

4. The container of claim 1, wherein the angle (θ) is from 1 to 5 degrees, relative to horizontal.

5. The container of claim 1, wherein the inwardly sloping continuous puncture region has a height at a center of the base from 0.25 to 1.0 mm.

6. The container of claim 1, wherein the container comprises a thermoplastic polymer selected from the group consisting of polypropylene, polystyrene, nylon, polyethylene, and combinations thereof.

7. The container of claim 6, wherein the thermoplastic polymer is blended with one or more additives.

8. The container of claim 7, wherein the one or more additives are selected from the group consisting of metallic stearates, calcium carbonate, talc, clays, and combinations thereof.

9. The container of claim 7, wherein the one or more additives comprise metallic stearates selected from the group consisting of calcium stearate, magnesium stearate, zinc stearate, and combinations thereof.

10. The container of claim 1, wherein the container comprises a thermoplastic material including a thermoplastic polymer, a nucleating agent in an amount from 0.5 to 5.0% by weight of the thermoplastic material, and talc in an amount from 7.0 to 18.0% by weight of the thermoplastic material.

11. The container of claim 1, wherein the container comprises a thermoplastic material including a polyolefin, a nucleating agent in an amount from 0.5 to 2.5% by weight of the thermoplastic material, and talc in an amount from 7.0 to 12.0% by weight of the thermoplastic material.

12. The container of claim 1, further comprising a feature imprinted on an inner surface of the base, wherein the feature functions to increase the punctureability of the base.

13. The container of claim 1, wherein the container is recyclable.

14. The container of claim 1, wherein the container comprises a monolayer material comprising polypropylene in an amount of at least 70 percent by weight, or a multilayer material in which at least one layer comprises polypropylene in an amount of at least 70 percent by weight.

15. The container of claim 14, wherein the container comprises a multilayer material and the at least one layer of the multilayer material comprises an outermost layer opposite the cavity.

16. The container of claim 15, wherein an innermost layer adjacent the cavity comprises polypropylene in an amount of at least 70 percent by weight, and the multilayer material comprises a barrier layer between the innermost and outermost layers.

17. The container of claim 16, wherein the barrier layer comprises ethylene vinyl alcohol.

18. A container for forming a beverage comprising the container of claim 1, and further comprising:

a filter disposed in the cavity of the container and defining first and second chambers in the cavity;

a beverage medium disposed in the cavity and arranged to interact with a liquid introduced into the container to form a beverage; and a lid attached to a rim of the container to contain the beverage medium and filter disposed therein.

19. The container of claim 1, further comprising a lip which radially protrudes outwardly from the wall, opposite the base.

20. The container of claim 1, wherein the ratio of an effective distance from the edge of the base to the outer support structure ($d_o$) to the radius of the base (R) is from 0.01:1 to 0.2:1.

21. The container of claim 1, wherein the continuous puncture region is punctureable by a single needle and displays a puncture load of less than 3 kg, measured using a sharp needle comprising a pointed puncture point, or of less than 5 kg, measured using a dull needle comprising a curved puncture point.

* * * * *